US005369712A

United States Patent [19]

Choi

[11] Patent Number: 5,369,712

[45] Date of Patent: Nov. 29, 1994

[54] SPEAKER

[76] Inventor: Beom-Tack Choi, Ra-202, Daedong yunlip, 460-4 Amsa-1Dong, Kangdong-Ku, Seoul, Rep. of Korea

[21] Appl. No.: 812,059

[22] Filed: Dec. 17, 1991

[30] Foreign Application Priority Data

Dec. 27, 1990 [KR] Rep. of Korea ..... 22056/1990

[51] Int. Cl.[5] ..... H04R 25/00

[52] U.S. Cl. ..... 381/159; 381/153; 381/199

[58] Field of Search ..... 381/159, 158, 205, 88, 381/90, 153, 160; 181/156, 155, 153, 199, 151, 152, 166

[56] References Cited

U.S. PATENT DOCUMENTS

| | | | |
|---|---|---|---|
| 2,310,243 | 2/1943 | Klipsch | 181/156 |
| 3,089,562 | 5/1963 | Morgillo | 181/156 |
| 4,168,761 | 9/1979 | Pappanikolaou | 181/156 |
| 4,454,927 | 6/1984 | Seebinger | 181/152 |
| 4,898,260 | 2/1990 | Fang | 181/156 |
| 4,969,196 | 11/1990 | Nakamura | 181/152 |
| 5,025,886 | 6/1991 | Jung | 181/156 |

FOREIGN PATENT DOCUMENTS

| | | | |
|---|---|---|---|
| 2509369 | 10/1976 | Germany | 181/156 |
| 0423291 | 7/1947 | Italy | 181/156 |
| 0220599 | 9/1990 | Japan | 381/159 |
| 0310421 | 7/1971 | U.S.S.R. | 381/192 |

*Primary Examiner*—Curtis Kuntz
*Assistant Examiner*—Huyen D. Le
*Attorney, Agent, or Firm*—Blakely, Sokoloff, Taylor & Zafman

[57] ABSTRACT

Present invention relates to a speaker which is installed and utilized to the various kinds of the audio systems, it is comprised that in the backward of the speaker, a frame main body having a noise filtering means is installed so that the whole voice frequency radiated to the backward of the vibration plate of the speaker can be outputted to the foreward and having a circulating exhaust means of the voice frequency so that the voice frequency radiated from the backward of the speaker can be filtered and returned back to the foreward then it is possible that to listen the whole voice frequency which is radiated to the foreward and to the backward of the speaker without any loss, and the noise is filtered during the proccess of returning back of the voice frequency through the circulation exhaust means, and thus the good quality of the original voice frequency can be obtained simultaneously.

7 Claims, 5 Drawing Sheets

SPEAKER

FIELD OF THE INVENTION

The present invention relates to a speaker which is installed and used for various kinds of audio system. More in detail, the amplification effect of the voice frequency can be obtained and also provided the good quality of original sound and being listened to the user by out putting the whole amount of voice frequency radiated to the backward of the speaker vibration plate, and by filtering the voice frequency without any loss.

BACKGROUND OF THE INVENTION

In general, conventional speaker has been used, as shown in FIG. 6, a trumpet-shaped frame having permanent magnet to the backward is installed and on the whole surface of the inner side of the frame, a vibration plate is installed to change the electrical signal to voice signal by its vibration, and onto the frame, speaker is composed by forming a large number of the through hole so that the voice frequency radiated to the backward among the radiated voice frequency by the vibration of the vibration plate, can be smoothly radiated to the backward and the speaker composed as the above is fixedly installed to the inside of the case.

Conventional speaker composed as the above, the voice frequency generated from the vibration plate according to the vibration of the vibration plate is radiated to the foreward and backward of the vibration plate, then the voice frequency radiated to the foreward of the vibration plate is radiated to the foreward through the exhaust radiating hole composed to the foreward of the speaker case and then the user can listen it, but the voice frequency radiated to the backward of the vibration plate is radiated to the backward of the speaker through the through hole of the frame formed to the backward of the vibration plate.

The voice frequency radiated to the backward is reflected by the wall surface of the case inner side and it spreads out again to the new direction according to the direction of the wall surface and a part of the voice frequency is diminished by reflecting to the another wall surface, so there was a problem such as generating the noise as there exists new vibration by mixing the rest of the voice frequency reflecting continuously to the new voice frequency coming out to the backward of the vibration plate.

DISCLOSURE OF THE INVENTION

Accordingly, the present invention is to solve the above said conventional problem and to provide a speaker comprised with a frame having a circulation exhaust means and a filtering means of the voice frequency so that the whole voice frequency radiated to the backward of the speaker vibration plate can be filtered and outputted perfectly.

BEST MODE FOR CARRYING OUT THE INVENTION

Figure 1:
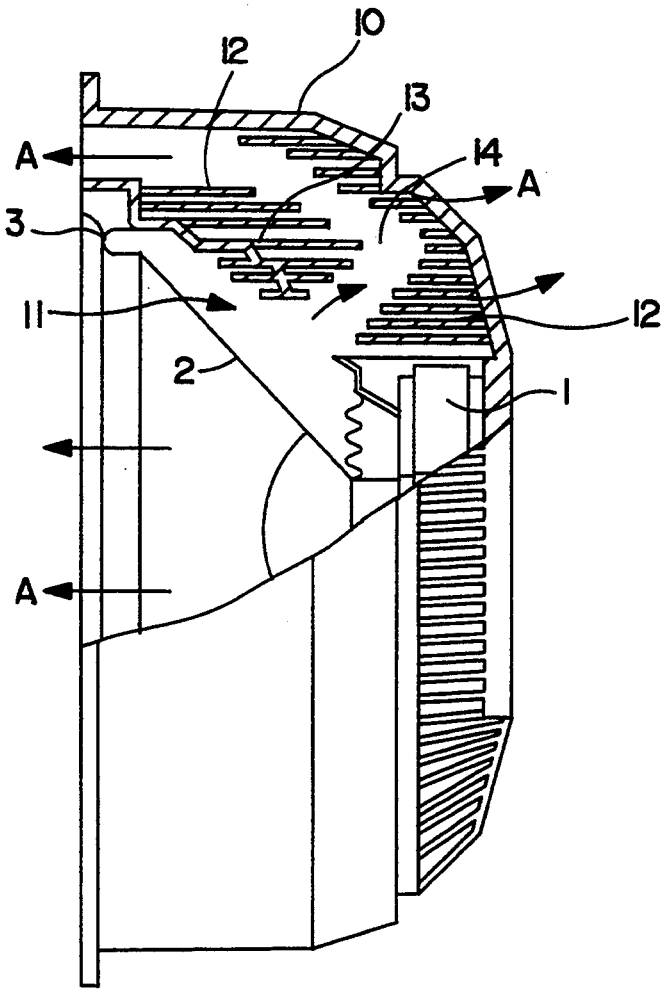
FIG. 1 is a cross sectional view showing the structure of the speaker according to the present invention.

Description is now made in detail according to the present invention with reference to accompanying drawings.

FIGS. 1 to 4 are drawings showing the structure of the speaker according to the preferred embodiment of the present invention.

At the central part of the inner side of the frame main body 10. installation space portion 11 is formed so that the main speaker 3 having a permanent magnet 1 to the backward and a vibration plate 2 to the foreward can be installed therein.

This installation space portion 11 is formed as similar shape as the main speaker 3 so that the main speaker 3 can be inserted and installed to the filtering pin 12 for filtering the voice frequency radiated to the backward when the vibration plate 2 is vibrating.

Above said filtering pin 12 is formed as a concentric circle shape for filtering and circulating the voice frequency radiated to the backward of the vibration plate 2 and by connecting the connecting pin 13 formed as a radial shape between the each filtering pin 12 to the filtering pin 12 each other, thus the circulation space for the voice frequency is constituted.

Figure 2:
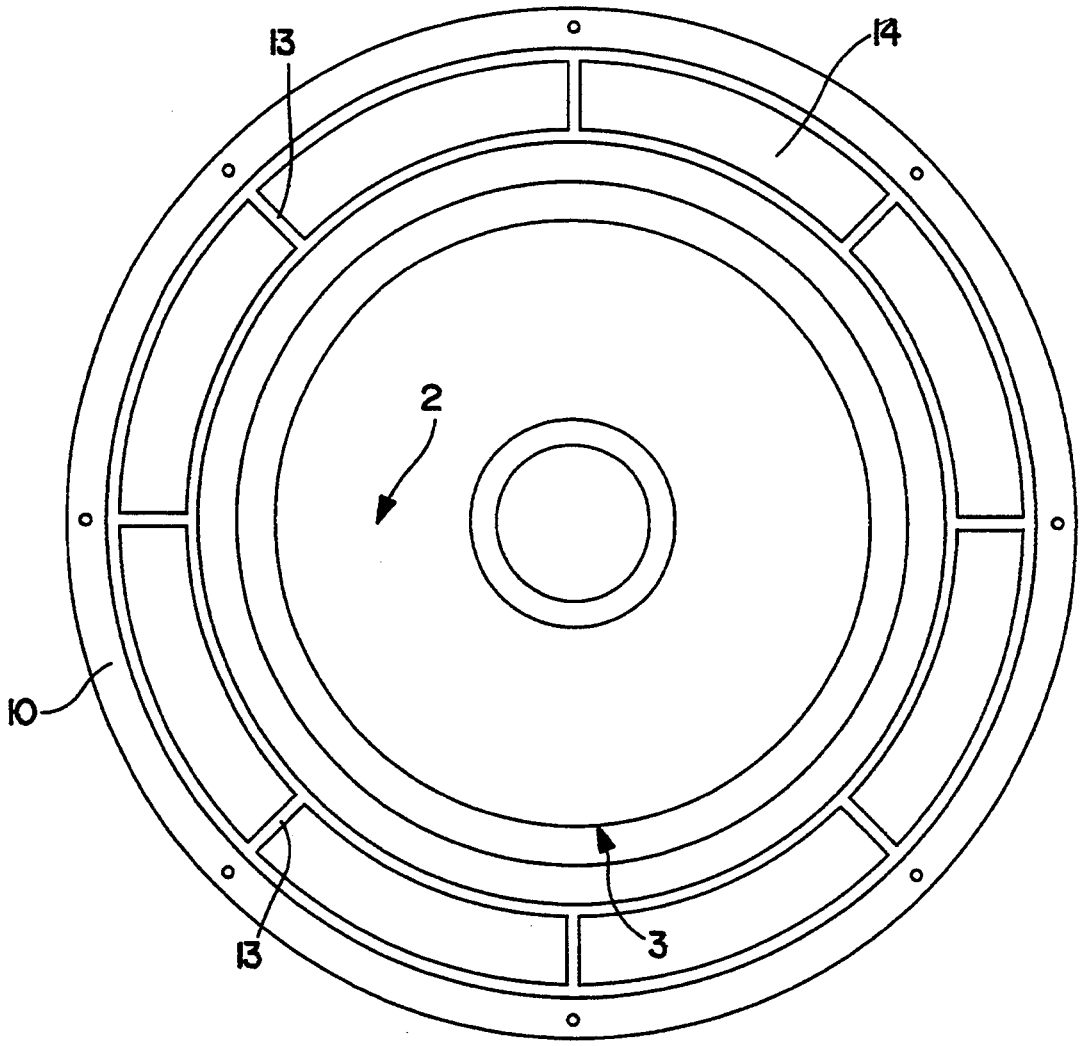
FIG. 2 is a left side view of the FIG. 1.

And as shown in FIGS. 1 and 2, at the inner side of the frame main body 10 formed by the above said filtering pin 12 and as on, the plurarity of exhaust path 14 is constituted which can exhaust the voice frequency A radiated to the backward of the vibration plate 2, to the foreward after filtering and amplifying the voice frequency.

Figure 3:
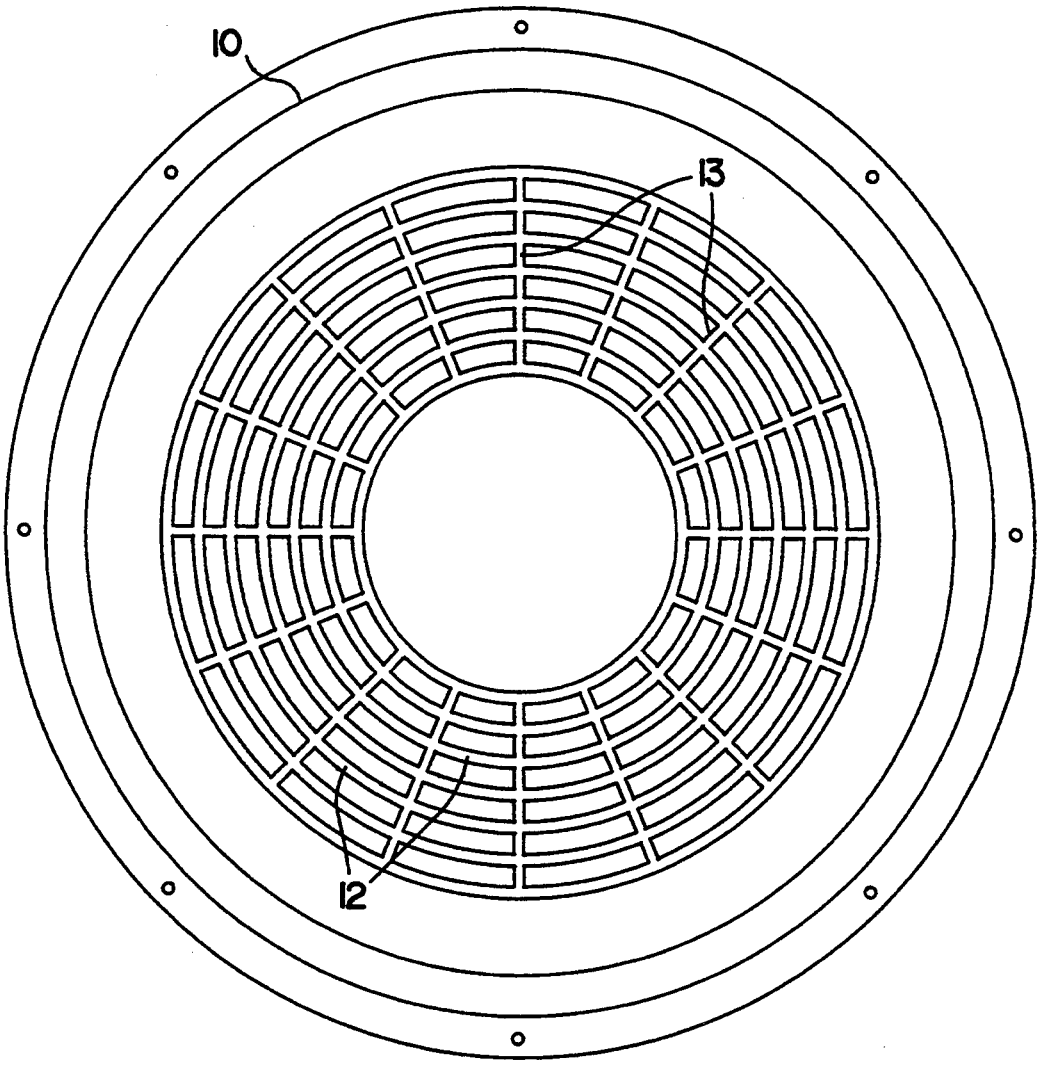
FIG. 3 is a right side view of the FIG. 1.
Figure 5:
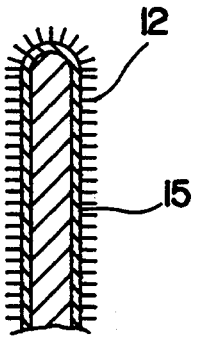
FIG. 5 is a cross sectional view showing the filtering pin of the speaker frame which is extracted and magnified according to the present invention.
Figure 6:
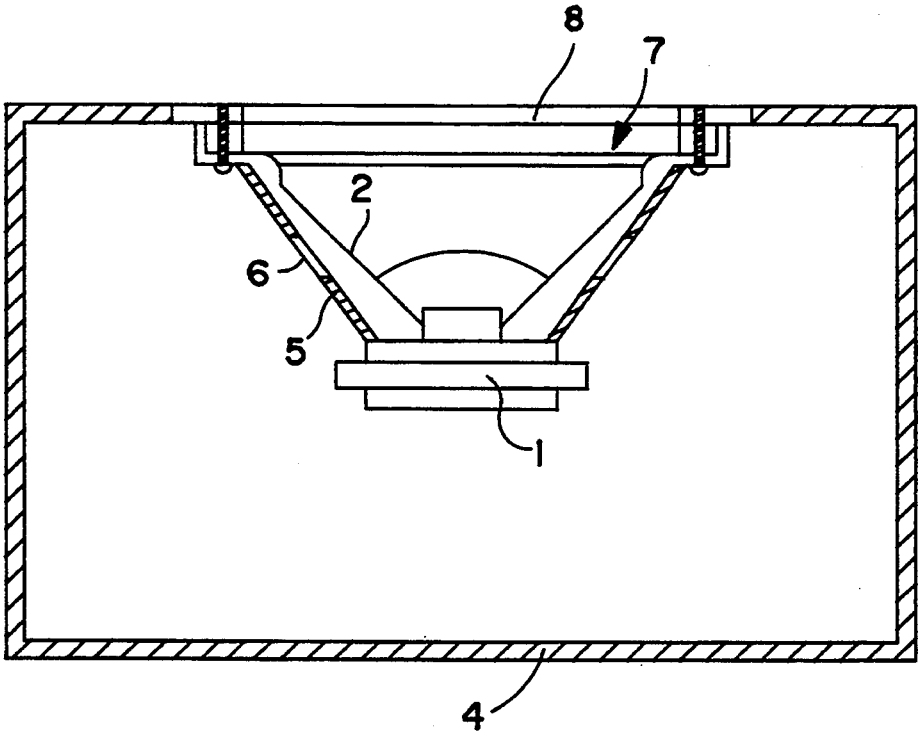
FIG. 6 is a plan cross sectional view showing the conventional speaker and the installation state of the speaker.

And as shown in FIGS. 1 and 3, between the foreward and the backward of the each filtering pin 12 is made open so that the above said voice frequency can get in and out and also circulate to the backward of the frame main body 10, and as shown in FIG. 5, on the whole surface of the plurality of the filtering pin 12 which is made by casting with aluminium, the cilia 15 is attached to exclude the noise by filtering.

Figure 4:
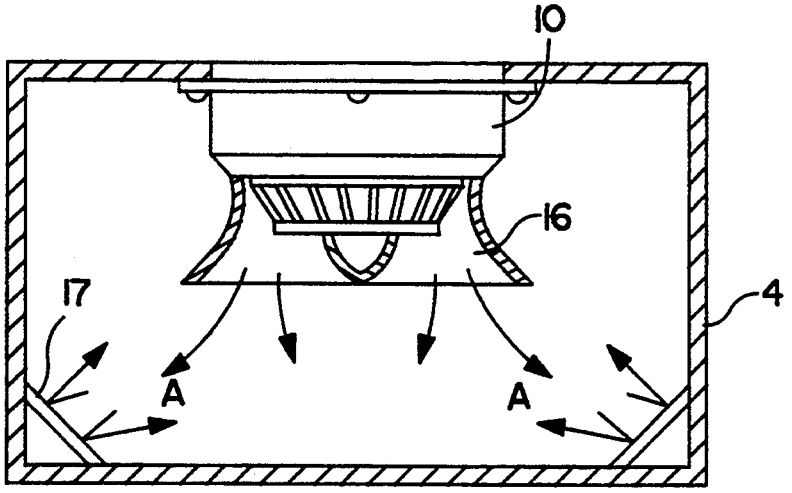
FIG. 4 is a plan cross sectional view showing the installation state of the speaker according to the present invention.

And as shown in FIG. 4 on the backward of the whole circumferences of which the open portion of the filtering pin 12 and the backward of the frame main body 10, a trumpet-shaped tube 16 is installed which can scatter and radiate the voice frequency radiated to the backward of the vibration plate 2 and then coming out through the each filtering pin 12. And on the inner wall of the backward of the case 4, a reflection plate 17 is installed for reflecting the voice frequency A which is coming out through the above said trumpet-shaped tube 16.

Description is now made according to the present invention about the application effect composed as the above.

First of all, by changing the electrical signal to the voice signal and vibrating the vibration plate 2 of the main speaker 3, then the voice frequency A generated by the vibration of the vibration plate 2 is radiated to the foreward and the backward of the vibration plate 2, respectively, and in general, about 70% of the voice frequency is radiated to the foreward and then the user can listen it, but the rest of the 30% of the voice frequency is radiated to the backward of the vibration plate 2.

The voice frequency A radiated to the backward of the vibration plate 2 is coming out through the plurality of the exhaust path 14 by passing through the plurality of the filtering pin 12 and so on from the installation space portion 11 located backward of the vibration plate 2.

And then a part of the vioce frequency is exhausted to the backward of the frame main body 10 through the each filtering pin 12 of which the backward is opened.

And the voice frequency exhausting to the backward of the above said frame main body 10, as shown in FIG. 4, is exhausted to the backward of the case 4 passing through the trumpet-shaped tube 16 installed to the backward of the opened frame main body 10.

And the voice frequency exhausted like this is reflected to the reflection plate 17 installed to the inner wall of the case 4, and again it flows into the inner side of the frame main body 10 passing through the trumpet-shaped tube 16.

Then the voice frequency flowed as the above is exhausted and radiated to the foreward by passing through each filtering pin 12 and so on, and through the plurality of the exhaust path 14 formed between the filtering pin 12 of the inner side of the frame main body 10.

As shown in FIG. 5, the noise among the whole voice frequency A radiated to the backward of the vibration plate 2 which is passing through the each filtering pin 12, is filtered by a large number of the cilia 15 attached on the surface of the filtering pin 12, thus the good quality of the voice frequency can be obtained.

In the present invention described in the above the exhaust path is formed so that the whole amount of the voice frequency radiated to the backward of the speaker can return to the foreward, and is formed between the plurality of the filtering pin 12 having a large number of the cilia 15 on it's surface, so the noise of the voice frequency coming out to the backward of the speaker is filtered and then the whole amount of the voice frequency is exhausted and radiated to the foreward.

In the present invention it is achieved that the whole amount of the voice frequency is outputted to the foreward after filtering it almost completely, while the whole voice frequency radiated to the backward of the conventional speaker was totally vanished within the inside of the case.

And there is a great distinct effect by returning the voice frequency back to the foreward and also resulting the effect of amplifying the voice frequency, while in the conventional speaker, the voice frequency radiated to the backward of the speaker was vanished totally.

What is claimed:

1. A speaker comprising a main speaker having a permanent magnet to the backward and a vibration plate to the forward installed to the inner side of a speaker case, a frame main body having a filtering means for filtering the whole voice frequency radiated to the backward of the vibration plate and a circulation exhaust means for radiating the filtered voice frequency by passing through the filtering means to the outside of the main speaker installed to the backward of the main speaker and then returning the filtered voice frequency to the forward, wherein the frame main body has a plurality of filtering pins formed with constant space so that the edge of the forward circumference and the backward of the filtering pins are opened defining an installation space portion concentric to the main speaker situated to the inner side of the forward central portion of the frame main body.

2. A speaker according to claim 1 wherein above said circulation exhaust means is formed by an exhaust path defined by said filtering pins so that the circulating voice frequency through the above said plurality of filtering pins can be exhausted and radiated to the forward.

3. A speaker according to claim 1 wherein the above said filtering means is formed by attaching a large number of cilia to the whole surface of the plurality of filtering pins so that the noise of the voice frequency which is circulating through the filtering pins can be filtered.

4. A speaker according to claim 1 wherein a trumpet-shaped tube is installed to the backward open portion of the frame main body so that the voice frequency radiated to the backward can be scattered and radiated to the backward, and then can be re-collected and transmitted back to the forward.

5. A speaker according to claim 4 wherein on the inner side of the speaker case, a reflection plate is installed for reflecting the voice frequency coming out from the trumpet-shaped tube and for flowing into the frame main body for exhausting and radiating the voice frequency to the outside of the speaker.

6. A speaker comprising a main speaker having a permanent magnet to the backward and a vibration plate to the forward installed to the inner side of a speaker case, a frame main body having a filtering means for filtering the whole voice frequency radiated to the backward of the vibration plate and a circulation exhaust means for radiating the filtered voice frequency by passing through the filtering means to the outside of the main speaker installed to the backward of the main speaker and then returning the filtered voice frequency to the forward, wherein above said circulation exhaust means is formed by an exhaust path defined by a plurality of filtering pins so that the circulating voice frequency through the above said plurality of filtering pins can be exhausted and radiated to the forward.

7. A speaker comprising a main speaker having a permanent magnet to the backward and a vibration plate to the forward installed to the inner side of a speaker case, a frame main body having a filtering means for filtering the whole voice frequency radiated to the backward of the vibration plate and a circulation exhaust means for radiating the filtered voice frequency by passing through the filtering means to the outside of the main speaker installed to the backward of the main speaker and then returning the filtered voice frequency to the forward, wherein the above said filtering means is formed by attaching a large number of cilia to the whole surface of plurality of filtering pins so that the noise of the voice frequency which is circulating through the filtering pins can be filtered.

* * * * *